US008876993B2

(12) United States Patent
Miyata et al.

(10) Patent No.: US 8,876,993 B2
(45) Date of Patent: Nov. 4, 2014

(54) METHOD FOR MANUFACTURING AN EXTRUDED MATERIAL OF HEAT TREATMENT TYPE AL—ZN—MG SERIES ALUMINUM ALLOY

(75) Inventors: Yukimasa Miyata, Shimonoseki (JP); Shinji Yoshihara, Shimonoseki (JP); Minwoo Kang, Shimonoseki (JP)

(73) Assignee: Kobe Steel, Ltd., Kobe-shi (JP)

( * ) Notice: Subject to any disclaimer, the term of this patent is extended or adjusted under 35 U.S.C. 154(b) by 244 days.

(21) Appl. No.: 13/419,798

(22) Filed: Mar. 14, 2012

(65) Prior Publication Data

US 2012/0234440 A1 Sep. 20, 2012

(30) Foreign Application Priority Data

Mar. 16, 2011 (JP) ..... 2011-058596

(51) Int. Cl.
*C22F 1/053* (2006.01)

(52) U.S. Cl.
USPC ..... 148/690; 148/701

(58) Field of Classification Search
USPC ..... 148/690, 701; 420/532, 541
See application file for complete search history.

(56) References Cited

U.S. PATENT DOCUMENTS

2007/0204937 A1* 9/2007 Buerger et al. ..... 148/552
2011/0017366 A1* 1/2011 Yoshida et al. ..... 148/550

FOREIGN PATENT DOCUMENTS

JP 9-310141 12/1997
JP 11-80876 3/1999

* cited by examiner

*Primary Examiner* — Roy King
*Assistant Examiner* — Janelle Morillo
(74) *Attorney, Agent, or Firm* — Oblon, Spivak, McClelland, Maier & Neustadt, L.L.P.

(57) ABSTRACT

A casted ingot of a heat treatment type Al—Zn—Mg series aluminum alloy comprising Zn: 4.0-8.0% by mass, Mg: 0.5-2.0% by mass, Cu: 0.05-0.5% by mass, Ti: 0.01-0.1% by mass, and any one or more of Mn: 0.1-0.7% by mass, Cr: 0.1-0.5% by mass and Zr: 0.05-0.3% by mass, and the balance being aluminum and incidental impurities is extruded at a homogenization treatment temperature after a homogenization treatment without cooled, and a resulted extruded material is die quenched at a cooling rate equal to or more than 100° C./min and then subjected to an artificial aging treatment, wherein the homogenization treatment is carried out by heating to the homogenization treatment temperature as 430-500° C. at a heating rate less than 750° C./hr or by heating to the homogenization treatment temperature and held the homogenization treatment temperature for 3 hours.

3 Claims, No Drawings

METHOD FOR MANUFACTURING AN EXTRUDED MATERIAL OF HEAT TREATMENT TYPE AL—ZN—MG SERIES ALUMINUM ALLOY

FIELD OF THE INVENTION

This invention relates to a method for manufacturing an extruded material of a heat treatment type Al—Zn—Mg series (JIS 7000 series) aluminum alloy that is known as having a high strength.

DESCRIPTION OF THE RELATED ART

An extruded material of a heat treatment type Al—Zn—Mg series (JIS 7000 series) aluminum alloy is manufactured, for instance as described in JP H9-310141A and JP H11-80876A, generally by subjecting an ingot obtained from a DC casting to a homogenization treatment, cooling down the ingot from the homogenization treatment temperature and then cutting the ingot into an extrusion size (extrusion billet), extruding the obtained extrusion billet with rapidly heating to a certain temperature, water cooling or air cooling the extruded material immediately after extrusion on the extruding line (die quench water cooling, die quench air cooling), and subjecting the extruded material to an aging treatment. Alternatively, there is a case where after the extrusion the material is subjected to a solution heat treatment with reheated and hardened after extrusion, and next subjected to an aging treatment.

By subjecting to the homogenization treatment, segregation of Zn and Mg can be omitted, and fine Al-transition metal (such as Mn, Cr, Zt) based grains can precipitate. The Al-transition metal based grain has a function to prevent the recrystallized grain from coarsening in the extruded material. By rapidly cooling the ingot after the homogenization treatment, coarsened precipitation of $Mg_2Zn$ when cooling is prevented. At this time, if the precipitated $Mg_2Zn$ is small, it can be dissolved by heating (rapid heating) just before the extrusion. Further, by carrying out the heating of billet just before the extrusion as a rapid heating, the Al-transition metal based grain can be avoided from coarsening.

Since the DC casted ingot is forcibly cooled by water cooling just after the solidification, the solute element segregates such as in a boundary of dendrite/cell. One purpose of the homogenization treatment is to eliminate this segregation of the solute element in the ingot.

On the other hand, the homogenization treatment is mostly carried out industrially with an air furnace, and cooling after the homogenization treatment is carried out generally with a combination of cooling in the furnace and following air cooling outside the furnace. However, the extrusion billet is large as having a diameter around 350 mm, and therefore a cooling rate after the homogenization treatment can not be increased. As a result of that, in the cooling process after the homogenization treatment, the precipitate ($Mg_2Zn$) to contribute the strength of the extruded material coarsens. Especially, this propensity is stronger in the central portion of the billet.

The precipitate of $Mg_2Zn$ coarsened at this stage can not be sufficiently dissolved by billet heating just before the extrusion. Therefore, an extruded material which is die quenched just after extrusion and next subjected to an aging treatment has a significantly low strength in comparison to an extruded material which is reheated after extrusion, subjected to a solution heat treatment and a quenching (water cooling), and next subjected to an aging treatment (referred as solution heat treated material below). In order to prevent the strength from decreasing as the above, it is thought to add Zn and Mg more than essential requirement. However, in such case, another problem as reductions in extrusion ability and stress corrosion cracking resistance (referred as SCC resistance below) is caused.

Furthermore, in a case where the homogenization treatment is industrially carried out in an air furnace, variances in temperature rising rate, retention time and cooling rate between a central portion and a peripheral portion of the furnace are caused. Therefore, the billets subjected to the homogenization treatment in the central portion and in the peripheral portion are different in temperature rising rate, retention time and cooling rate, and so solution levels of solute element (precipitation level of $Mg_2Zn$) get variance depending on the ingots. The variance can not be eliminated in the billet heating just before the extrusion, and the variance can not be eliminated by die quenching just after the extrusion. Consequently, there is also a problem that the variance causes a variation in material characteristics after extrusion, in the case where an aging treatment is next carried out.

The main object of the present invention is to enable obtaining an extruded material having a high strength close to that of the solution heat treated material in a method for manufacturing an extruded material of a heat treatment type Al—Zn—Mg series (JIS 7000 series) aluminum alloy, particularly in a case where the extruded material is die quenched just after an extrusion and next subjected to an aging treatment. Also, another object of the present invention is to prevent extruded material from varying in material characteristics as conventionally caused.

SUMMARY OF THE INVENTION

The problem that an Al—Zn—Mg series aluminum alloy extruded material is degraded in a strength in a case where an extruded material is die quenched just after extrusion and next subjected to an aging treatment in comparison to a solution heat treated material is solved, if Zn and Mg can be sufficiently dissolved at the stage of billet heating just before the extrusion.

Since, in a DC casted ingot, coarsened Zn and Mg precipitate in a cooling step after a homogenization treatment, according to the present invention, a DC casted ingot after subjected to a homogenization treatment is used in extrusion without cooling as conventional. Thereby, Zn and Mg dissolved in the homogenization treatment are prevented from precipitating.

Accordingly, a method for manufacturing an extruded material of a heat treatment type Al—Zn—Mg series aluminum alloy according to the present invention is characterized by DC casting heat treatment type Al—Zn—Mg series aluminum alloy to form a billet, heating the billet to a homogenization treatment temperature at a heating rate less than 750° C./hr to extrude without subjecting to a homogenization treatment, die quenching the extruded material at a cooling rate equal to or more than 100° C./min, and then subjecting the extruded material to an artificial aging treatment. The die quenching is possible to be air cooling or water cooling or combination thereof.

Alternatively, a method according to the present invention is characterized by DC casting heat treatment type Al—Zn—Mg series aluminum alloy to form a billet, heating the billet to a homogenization treatment temperature and holding at the temperature for 3 hours or longer without subjecting to a homogenization treatment, die quenching the extruded material at a cooling rate equal to or more than 100° C./min, and then subjecting the extruded material to an artificial aging treatment.

According to the present invention, a DC casted ingot before subjecting a homogenization treatment is cut into a extrusion billet, and the extrusion billet is heated to a homogenization treatment temperature and then extruded without cooled after heated. Therefore, Zn and Mg are maintained as in a sufficiently dissolved state in the extruded billet, and the Zn and Mg are maintained as a sufficiently dissolved state in an extruded material after die quenched as well. Accordingly, by an aging treatment after die quenching, dissolved Zn and Mg can be precipitated in full measure as a precipitate of $Mg_2Zn$ having a size that can contribute for the strength, hence a extruded material with a high strength close to that of a solution heat treated material can be manufactured without addition of Zn and Mg more than essential requirement. Further, in connection with that an additive amount is not increased more than the requirement, an ability of extrusion is improved (extrusion rate is increased) and SCC resistance is prevented from degrading.

In the present invention, the homogenization treatment functions as well as a billet heating prior to the extrusion, and the homogenized material is extruded without cooled. Therefore, it is not practical to carry out the homogenization treatment with a conventional large air furnace, and it is preferable to carry out the homogenization treatment in a manner similar to conventional billet heating, for instance using an induction heater. Because the homogenization treatment is not carried out with a conventional large air furnace, conventionally caused variances among ingots in heating rate, retention time and cooling time can be eliminated. As a result of that, variances in solution levels of the solute element (precipitation levels of $Mg_2Zn$) among ingots is not caused, and with such a perspective, material characteristics of the extruded material can be stable.

On the other hand, the homogenization treatment functions to finely precipitate Al-transition metal based grains which uniform segregation and inhibit a recrystallized grain from coarsening in the extruded material, as in the conventional method. According to the present invention, therefore, a billet is heated to the homogenization treatment temperature (same as the extrusion temperature) at a heating rate less than 750° C./hr, or a billet is heated to the homogenization treatment temperature and then kept the same temperature more than 3 hr. Thereby, the segregation in the billet is uniformed, and Al-transition metal based grains finely precipitate in the billet. Thanks to the fine precipitation of Al-transition metal based grains, a segregation of recrystallized grains in the resulted extruded material is avoided so as to improve the SCC resistance to the same level with conventional manufacturing methods.

DETAILED DESCRIPTION OF THE PREFERRED EMBODIMENT

Hereinafter, a method for manufacturing an extruded material of a heat treatment type Al—Zn—Mg series aluminum alloy will be described more specifically.

(Composition of Aluminum Alloy)

The present manufacturing method can be applied for a general heat treatment type Al—Zn—Mg series (JIS 7000 series) aluminum alloy. Specifically, this heat treatment type Al—Zn—Mg series aluminum alloy comprises Zn: 4.0-8.0% by mass, Mg: 0.5-2.0% by mass, Cu: 0.05-0.50% by mass, Ti: 0.01-0.1% by mass, and one or more of Mn: 0.1-0.7% by mass, Cr: 0.1-0.5% by mass and Zr: 0.05-0.3% by mass, and the balance substantially being aluminum and incidental impurities. Functions of each element are explained below.

Zn:

Zn coexists with Mg to provide an aging ability to heat treatment type Al—Zn—Mg series aluminum alloy, and therefore has a function to enhance strength by precipitating ($Mg_2Zn$) in an artificial aging. However, if the content of Zn is less than 4.0% by mass, the strength of the alloy is insufficient, and if the content of Zn is more than 8.0% by mass, the SCC resistance of the alloy is reduced. Therefore, the content of Zn is to be 4.0-8.0% by mass.

Mg:

Mg is a major element to enhance strength of a heat treatment type Al—Zn—Mg series aluminum alloy. However, if the content of Mg less than 0.5% by mass, the strength of the alloy is insufficient, and if the content of Mg is more than 2.0% by mass, the extrusion ability (possible extrusion rate) of the alloy is reduced to decrease tempering starting temperature in die quench air cooling, so that a high strength close to that of the conventional solution heat treated material can not be obtained. Therefore, the content of Mg is to be 0.5-2.0% by mass.

Cu:

Cu has a function to enhance strength of heat treatment type Al—Zn—Mg series aluminum alloy and a function to improve SCC resistance. However, if the content of Cu is less than 0.05% by mass, the effect of the element is insufficient, and if the content of Cu is more than 0.5% by mass, the extrusion ability (possible extrusion rate) of the alloy is reduced to decrease tempering starting temperature in die quench air cooling, so that a high strength close to that of the conventional solution heat treated material can not be obtained. Therefore, the content of Cu is to be 0.05-0.5% by mass.

Ti:

Ti has a function to miniaturize grains in an ingot. However, if the content of Ti is more than 0.1% by mass, a big compound is generated due to saturation of the grain miniaturization effect. And, the grain miniaturization effect can not be sufficiently achieved with a content of Ti less than 0.01% by mass. Therefore, the content of Ti is preferably 0.01-0.1% by mass.

Mn, Cr, Zr:

Mn, Cr, Zr have a effect to inhibit recrystallized grain from coarsening in a heat treatment type Al—Zn—Mg series aluminum alloy extruded material, so as to improve SCC resistance. However, if the contents of Mn, Cr, Zr are respectively less than 0.1% by mass, 0.1% by mass, 0.05% by mass, effects of the elements are insufficient. And, if the contents of Mn, Cr, Zr are respectively more than 0.7% by mass, 0.5% by mass, 0.3% by mass, an extrusion ability of the alloy is reduced and a quenching sensitivity is increased to cause strength reduction. Therefore, the content of one of Mn, Cr, Zr is determined in ranges for Mn: 0.1-0.7% by mass, Cr: 0.1-0.5% by mass, Zr: 0.05-0.3% by mass. In a case where two or more of Mn, Cr, Zr are contained, for the same reason as the above, the total content is preferably equal to or less than 0.7% by mass, and more preferably equal to or less than 0.5%.

Incidental Impurities:

Among contained elements as incidental impurities, Fe and Si crystallizes coarsened intermetallic compound while casting so as to impair mechanical characteristics of an alloy. Therefore, it is preferable to limit Fe up to 0.35% by mass, Si up to 0.15% by mass. Each of other impurity is to be equal to or less than 0.05% by mass, total content of other impurities is to be equal to or less than 0.15% by mass. It is noted that B among the impurities is mixed into the alloy in association with addition of Ti by an amount of about ⅕ of Ti, while a more preferable range is equal to of less than 0.02% by mass and further preferable range is equal to of less than 0.01% by mass.

(Manufacturing Method)

In a manufacturing method according to the present invention, a DC casted ingot of the above mentioned heat treatment type Al—Zn—Mg series aluminum alloy is subjected to a homogenization treatment and then extruded without cooled, and a resulted extruded material is die quenched and then subjected to an artificial aging treatment. The homogenization treatment functions as a billet heating prior to an extrusion in the conventional method. Hereinbelow, each step of the above manufacturing method will be explained.

Homogenization Treatment (First Alternative):

The extrusion billet is heated from room temperature to the homogenization treatment temperature at an average heating rate equal to or less than 750° C./hr, and then is extruded. Therefore, the homogenization treatment temperature is as the extrusion temperature. Notably, the homogenization treatment temperature is determined at a general homogenization treatment temperature, for instance in a range of 430-500° C. By setting the heating rate to the homogenization treatment temperature sufficiently lower than a heating rate (around 3000° C./hr) in a general billet heating in the conventional method, dissolved Mn, Cr and Zr can be finely precipitated as Al-transition metal based grains. In a case that the heating rate is more than 750° C./hr, the precipitation of Al-transition metal based grain is insufficient, so that recrystallized grains in the extruded material coarsen to cause reduction of a SCC resistance. On the other hand, form a point of view of productivity and cost, this heating rate is preferably equal to or more than 70° C./hr. After reaching to the homogenization treatment temperature, it is not necessary to keep the extruding billet at the same temperature for a certain time, and therefore it is possible to extrude the extruding billet immediately.

Homogenization Treatment (Second Alternative):

After hating the extrusion billet to the homogenization treatment temperature, the billet is kept at the same homogenization treatment temperature, and then the billet is extruded. Therefore, also in this case, the homogenization treatment temperature is as the extrusion temperature. The homogenization treatment temperature can be determined similarly, for instance in a range of 430-500° C. By keeping the billet at the homogenization treatment temperature for more than 3 hr, dissolved Mn, Cr and Zr can be finely precipitated as Al-transition metal based grains. In a case that the heating rate is high and the retention time is less than 3 hr, precipitation of Al-transition metal based grains is insufficient, so that the recrystallized grains coarsen to reduce the SCC resistance. On the other hand, from a point of view of productivity and cost, this retention time is preferably equal to or less than 6 hr. The heating rate to the homogenization treatment temperature is not specifically limited, and therefore it is possible to use a heating temperature equal to or lower than 750° C./hr and a heating temperature higher than 750° C./hr as well.

Die Quenching:

The die quenching of the extruded material may be carried out in a general condition for a heat treatment type Al—Zn—Mg series aluminum alloy. That means the extruded material is cooled down at a average cooling rate equal to or higher than 100° C./min from outlet temperature of an extruding die to 50° C. or less, by air cooling, water cooling or combination thereof. At a cooling rate lower than 100° C./min, dissolved Mg and Zn start to precipitate in the cooling step so as to become coarsened precipitates, and therefore the extruded material can not be improved sufficiently in strength even if an aging treatment is subsequently applied.

Aging Treatment:

The aging treatment may be carried out with a general aging treatment condition for a heat treatment type Al—Zn—Mg series aluminum alloy. Possible condition is, for instance, a two step aging treatment condition of 60-110° C.×2-12 hr and 120-150° C.×4-15 hr, or a condition of 110-130° C.×12-30 hr.

Embodiment 1

Heat treatment type Al—Zn—Mg series aluminum alloys with compositions shown in table 1 are DC casted to form ingots with a diameter of 155 mm. These ingots are cut into extrusion billets. These extrusion billets are subjected or not subjected to a homogenization treatment at a homogenization treatment temperature of 445-475° C. Then some of the billets are extruded at the homogenization treatment temperature without cooled, and the other billets are cooled after the homogenization treatment, and reheated to the extrusion temperature (as same as the homogenization treatment temperature) to be extruded. All of the sectional shapes of the extruded materials are a same form of a flat bar with 100 mm of width×5 mm of thickness. All of extruded materials are die quenched and then subjected to an aging treatment. Tables 2-4 show conditions of the homogenization treatment, conditions of pre-extrusion heating, and cooling rates of the die quenching.

In the tables 2-4, Nos. 1-13, 18-30, 35-47 are extruded at the homogenization treatment temperature directly, without cooling after the homogenization treatment. The tables 2-4 shows heating rates to the homogenization treatment temperature and retention times at the same homogenization treatment temperatures, as the homogenization treatment conditions. Nos. 14-17, 31-34, 48-51 is cooled to a room temperature after the homogenization treatment, and next reheated to the extrusion temperature to be extruded. The tables 2-4 shows homogenization treatment temperatures and retention times at the same homogenization treatment temperatures, as the homogenization treatment conditions, and heating rates to the extrusion temperatures and the retention times at the same extrusion temperatures as the pre-extrusion reheating conditions.

The Aging treatment is carried out in a condition with 70° C.×5 hr and next 130° C.×12 hr for Samples A and B and in a condition with 130° C.×24 hr for Sample C.

Meanwhile, for comparison, the extrusion billets of the samples A, B and C (Nos. 52-54) are subjected to a homogenization treatment in a same condition as No. 14 and then cooled to the room temperature, and next reheated to the extrusion temperature (same as the homogenization treatment temperature) to be extruded into the flat bar shape. The resulted extruded material is subjected to the solution heat treatment, then hardened (water cooled), and further subjected to the aging treatment to obtain solution heat treated materials (referred as T6 material, below). Table 5 shows conditions of the solution heat treatment, the hardening and the aging treatment.

TABLE 1

| | Alloy Series | Chemical composition (% by mass) | | | | | | | | |
|---|---|---|---|---|---|---|---|---|---|---|
| | | Si | Fe | Cu | Mn | Mg | Cr | Zn | Ti | Zr |
| A | 7N01 | 0.05 | 0.18 | 0.15 | 0.45 | 1.5 | — | 4.50 | 0.05 | — |
| B | 7003 | 0.05 | 0.18 | 0.15 | — | 0.8 | — | 5.80 | 0.05 | 0.15 |
| C | 7020 | 0.05 | 0.18 | 0.15 | 0.05 | 1.2 | 0.23 | 4.50 | 0.05 | 0.08 |

TABLE 2

| Sample A | | | | | | | | | | | | | | |
|---|---|---|---|---|---|---|---|---|---|---|---|---|---|---|
| | | Manufacturing Condition | | | | | | Tensile Characteristics | | | | | | |
| | | Homogenization Treatment | | | Pre-extrusion Heating | | Die Quenching | Tensile | Proof | | Strength Evaluation | | Micro | SCC |
| | No. | Heating Rate (° C./hr) | Retention Time (hr) | Cooling Rate (° C./hr) | Heating Rate (° C./hr) | Retention Time (hr) | Cooling Rate (° C./min) | Strength TS ($N/mm^2$) | Stress YS ($N/mm^2$) | Elongation (%) | $TS/TS_0$ | $YS/YS_0$ | structure | Resistance |
| Embodiment | 1 | 700 | 0.0 | — | Not Applied | | 120 | 425 | 346 | 14.5 | ○ | ○ | Δ | Δ |
| | 2 | 450 | 0.0 | — | Not Applied | | 120 | 426 | 349 | 14.9 | ○ | ○ | ○ | ○ |
| | 3 | 300 | 0.0 | — | Not Applied | | 120 | 428 | 351 | 15.2 | ○ | ○ | ○ | ○ |
| | 4 | 3000 | 3.0 | — | Not Applied | | 120 | 425 | 354 | 15.0 | ○ | ○ | ○ | ○ |
| | 5 | 3000 | 4.0 | — | Not Applied | | 120 | 428 | 351 | 15.3 | ○ | ○ | ○ | ○ |
| | 6 | 700 | 3.0 | — | Not Applied | | 120 | 428 | 352 | 14.7 | ○ | ○ | ○ | ○ |
| | 7 | 450 | 3.0 | — | Not Applied | | 120 | 423 | 356 | 15.0 | ○ | ○ | ○ | ○ |
| | 8 | 300 | 3.0 | — | Not Applied | | 120 | 430 | 355 | 15.0 | ○ | ○ | ○ | ○ |
| Comparison | 9 | 3000 | 0.0 | — | Not Applied | | 120 | 434 | 350 | 15.3 | ○ | ○ | X | X |
| | 10 | 3000 | 2.0 | — | Not Applied | | 120 | 430 | 352 | 14.9 | ○ | ○ | X | X |
| | 11 | 1000 | 0.0 | — | Not Applied | | 120 | 431 | 351 | 15.4 | ○ | ○ | X | X |
| | 12 | 1000 | 2.0 | — | Not Applied | | 120 | 430 | 356 | 15.2 | ○ | ○ | X | X |
| | 13 | 300 | 3.0 | — | Not Applied | | 50 | 398 | 330 | 15.6 | X | X | ○ | ○ |
| | 14 | 470° C. × 6 hr | | 350 | 700 | 0.0 | 120 | 395 | 320 | 15.3 | X | X | ○ | ○ |
| | 15 | 470° C. × 6 hr | | 350 | 700 | 4.0 | 120 | 394 | 321 | 15.6 | X | X | ○ | ○ |
| | 16 | 470° C. × 6 hr | | 350 | 300 | 4.0 | 120 | 395 | 325 | 15.0 | X | X | ○ | ○ |
| | 17 | 470° C. × 6 hr | | 350 | 300 | 0.0 | 120 | 392 | 328 | 15.6 | X | X | ○ | ○ |

TABLE 3

| Sample B | | | | | | | | | | | | |
|---|---|---|---|---|---|---|---|---|---|---|---|---|
| | | Manufacturing Condition | | | | | Tensile Characteristics | | | | | |
| | | Homogenization | Billet Heating Rate | Holding Time | Die Quenching Cooling Rate | Tensile Strength TS | Proof Stress YS | Elongation | Strength Evaluation | | Micro- | SCC |
| | No. | Treatment | (° C./hr) | (hr) | (° C./min) | ($N/mm^2$) | ($N/mm^2$) | (%) | $TS/TS_0$ | $YS/YS_0$ | structure | Resistance |
| Embodiment | 18 | Not Subjected | 700 | 0.0 | 120 | 412 | 336 | 15.7 | ○ | ○ | Δ | Δ |
| | 19 | Not Subjected | 450 | 0.0 | 120 | 416 | 338 | 14.9 | ○ | ○ | ○ | ○ |
| | 20 | Not Subjected | 300 | 0.0 | 120 | 413 | 335 | 15.2 | ○ | ○ | ○ | ○ |
| | 21 | Not Subjected | 3000 | 3.0 | 120 | 424 | 341 | 16.0 | ○ | ○ | ○ | ○ |
| | 22 | Not Subjected | 3000 | 4.0 | 120 | 419 | 346 | 14.8 | ○ | ○ | ○ | ○ |
| | 23 | Not Subjected | 700 | 3.0 | 120 | 420 | 345 | 15.0 | ○ | ○ | ○ | ○ |
| | 24 | Not Subjected | 450 | 3.0 | 120 | 420 | 349 | 15.4 | ○ | ○ | ○ | ○ |
| | 25 | Not Subjected | 300 | 3.0 | 120 | 418 | 348 | 15.6 | ○ | ○ | ○ | ○ |
| Comparison | 26 | Not Subjected | 3000 | 0.0 | 120 | 415 | 340 | 15.2 | ○ | ○ | X | X |
| | 27 | Not Subjected | 3000 | 2.0 | 120 | 414 | 342 | 15.3 | ○ | ○ | X | X |
| | 28 | Not Subjected | 1000 | 0.0 | 120 | 418 | 346 | 15.8 | ○ | ○ | X | X |
| | 29 | Not Subjected | 1000 | 2.0 | 120 | 420 | 341 | 15.2 | ○ | ○ | X | X |
| | 30 | Not Subjected | 300 | 3.0 | 50 | 385 | 323 | 15.4 | X | X | ○ | ○ |
| | 31 | 470° C. × 6 hr | 700 | 0.0 | 120 | 391 | 321 | 15.1 | X | X | ○ | ○ |
| | 32 | 470° C. × 6 hr | 700 | 4.0 | 120 | 393 | 321 | 15.6 | X | X | ○ | ○ |
| | 33 | 470° C. × 6 hr | 300 | 4.0 | 120 | 390 | 324 | 14.9 | X | X | ○ | ○ |
| | 34 | 470° C. × 6 hr | 300 | 0.0 | 120 | 389 | 325 | 15.8 | X | X | ○ | ○ |

TABLE 4

| Sample C | | | | | | | | | | | | |
|---|---|---|---|---|---|---|---|---|---|---|---|---|
| | | Manufacturing Condition | | | | Tensile Characteristics | | | | | | |
| | | Homogenization | Billet Heating Rate | Holding Time | Die Quenching Cooling Rate | Tensile Strength TS | Proof Stress YS | Elongation | Strength Evaluation | | Micro- | SCC |
| | No. | Treatment | (° C./hr) | (hr) | (° C./min) | (N/mm$^2$) | (N/mm$^2$) | (%) | TS/TS$_0$ | TS/TS$_0$ | structure | Resistance |
| Embodiment | 35 | Not Subjected | 700 | 0.0 | 120 | 385 | 324 | 15.4 | ○ | ○ | Δ | Δ |
| | 36 | Not Subjected | 450 | 0.0 | 120 | 384 | 326 | 15.3 | ○ | ○ | ○ | ○ |
| | 37 | Not Subjected | 300 | 0.0 | 120 | 385 | 321 | 15.0 | ○ | ○ | ○ | ○ |
| | 38 | Not Subjected | 3000 | 3.0 | 120 | 389 | 328 | 15.4 | ○ | ○ | ○ | ○ |
| | 39 | Not Subjected | 3000 | 4.0 | 120 | 387 | 324 | 14.9 | ○ | ○ | ○ | ○ |
| | 40 | Not Subjected | 700 | 3.0 | 120 | 387 | 329 | 14.9 | ○ | ○ | ○ | ○ |
| | 41 | Not Subjected | 450 | 3.0 | 120 | 385 | 327 | 15.1 | ○ | ○ | ○ | ○ |
| | 42 | Not Subjected | 300 | 3.0 | 120 | 386 | 325 | 15.7 | ○ | ○ | ○ | ○ |
| Comparison | 43 | Not Subjected | 3000 | 0.0 | 120 | 386 | 326 | 15.6 | ○ | ○ | X | X |
| | 44 | Not Subjected | 3000 | 2.0 | 120 | 384 | 324 | 15.2 | ○ | ○ | X | X |
| | 45 | Not Subjected | 1000 | 0.0 | 120 | 389 | 325 | 15.4 | ○ | ○ | X | X |
| | 46 | Not Subjected | 1000 | 2.0 | 120 | 382 | 324 | 15.0 | ○ | ○ | X | X |
| | 47 | Not Subjected | 300 | 3.0 | 50 | 372 | 307 | 15.0 | X | X | ○ | ○ |
| | 48 | 470° C. × 6 hr | 700 | 0.0 | 120 | 375 | 310 | 15.6 | X | X | ○ | ○ |
| | 49 | 470° C. × 6 hr | 700 | 4.0 | 120 | 371 | 309 | 15.4 | X | X | ○ | ○ |
| | 50 | 470° C. × 6 hr | 300 | 4.0 | 120 | 374 | 310 | 15.1 | X | X | ○ | ○ |
| | 51 | 470° C. × 6 hr | 300 | 0.0 | 120 | 370 | 305 | 15.5 | X | X | ○ | ○ |

TABLE 5

| T6 Processed Material | | | | | | | | | |
|---|---|---|---|---|---|---|---|---|---|
| | | Heat Treatment Condition | | | Tensile Characteristics | | | | |
| No. | Sample | Solution Heat Treatment | Hardening | Aging Treatment | Tensile Strength TS$_0$ (N/mm$^2$) | Proof Stress YS$_0$ (N/mm$^2$) | Elongation (%) | Micro structure | SCC Resistance |
| 52 | A | 450° C. × 2 hr | Water | 70° C. × 5 hr→130° C. × 12 hr | 440 | 360 | 15.0 | ○ | ○ |
| 53 | B | | Cooling | 70° C. × 5 hr→130° C. × 12 hr | 420 | 350 | 15.0 | ○ | ○ |
| 54 | C | | | 120° C. × 24 hr | 400 | 330 | 15.0 | ○ | ○ |

With the extruded material of the sample Nos. 1-54, tensile characteristics, microstructures and CSS resistances are checked in following manners. The results are shown in tables 2-5.

Tensile Characteristics:

Tensile test peaces under JIS No. 5 are cut out from the extruded materials respectively and tensile tests are carried out according to JIS 22241 to measure tensile strengths, proof stresses and elongations.

Notably, calculated are ratios (Ts/Ts$_0$, Ys/Ys$_0$) of the tensile strengths TS and the proof stresses Ys of T5 material (Nos. 1-51) which are subjected to the die quenching and the aging treatment with respect to the tensile strengths TS$_0$ and the proof stresses Ys$_0$ of T6 material (Nos. 52-54). Then, materials having a ratio equal to or higher than 0.95 are evaluated as good (0), and materials having a ratio less than 0.95 are evaluated as defect (x), and the evaluation results are described in columns of Strength Evaluation on the tables 2-4.

Microstructure:

Each extruded material are polished and etched with caustic soda, then observed microscopically to measure average grain diameters of recrystallized grains by intercept method of JIS. Measuring points are on a surface and at a central portion in thickness. Then, materials having average grain diameter of recrystallized grains less than 50 μm at the both measuring points are evaluated as good (○), materials having average grain diameter of recrystallized grains equal to or more than 50 μm and less than 100 μm at the both measuring points are evaluated as mediocre (Δ), materials having average grain diameter of recrystallized grains equal to or more than 100 μm at the both measuring points are evaluated as defect (x).

SCC Resistance:

Evaluation is made with a chromic acid acceleration method. Test peaces are cut out from respective extruded materials, and are applied with tensile stress as 90% of proof stress for Nos. 1-34, 52, 53 and tensile stress as 50% of proof stress for Nos. 35-51, 54 perpendicularly to the extruding direction of each test piece as three-point bending by a jig, with dipping in a test liquid that is 1 little of distilled water added with 36 g of chrome oxide, 30 g of potassium dichromate and 3 g of salt, it is checked whether a crack is present, every 0.5 hours. In this method, test pieces having caused SCC in 6 hours dipping are evaluated as defect (x), test pieces having caused SCC in 6-10 hours of dipping are evaluated as mediocre (Δ), test pieces not having caused SCC in 10 hours of dipping are evaluated as good (○).

Nos. 1-8 (sample A), Nos. 18-25 (sample B) and Nos. 35-42 (sample C) in the tables 2-4 are all made by the manufacturing method according to the present invention. These have tensile strengths and proof stresses more than 95% of T6 materials (Nos. 52-54) and microstructures (average grain diameters of recrystallized grains) smaller than 100 μm, so as to excel at SCC resistances.

However, Nos. 9-12 (sample A), Nos. 26-29 (sample B) and Nos. 43-46 (sample C) have microstructures (average grain diameters of recrystallized grains) equal to or grater than 100 μm so as to be inferior in SCC resistance, because the heating rates at pre-extrusion heating of the billets are higher and the retention times at the homogenization treatment temperature are less than 3 hours.

No. 13 (sample A), No. 30 (sample B) and No. 47 (sample C) have tensile strengths and proof stresses less than 95% of T6 materials (Nos. 52-54), because the cooling rates at die quenching are lower.

Nos. 14-17 (sample A), Nos. 31-34 (sample B) and Nos. 48-51 (sample C) have been subjected to the homogenization treatment, therefore have tensile strengths and proof stresses less than 95% of T6 materials (Nos. 52-56) while other conditions satisfy the conditions according to the present invention.

Embodiment 2

Heat treatment type Al—Zn—Mg series aluminum alloys with compositions shown in table 6 are DC casted to form ingots with a diameter of 155 mm. These ingots are cut into extrusion billets. These extrusion billets are subjected or not subjected to a homogenization treatment at a homogenization treatment temperature of 445-475° C. Then the billets are extruded at the homogenization treatment temperature without cooled. All of the sectional shapes of the extruded materials are a same form of a flat bar with 100 mm of width×5 mm of thickness. All of extruded materials are die quenched and then subjected to an aging treatment. Table 7 shows conditions of the homogenization treatment (heating rates to the homogenization treatment temperature and retention times at the same temperature), and cooling rates of the die quenching.

The Aging treatment is carried out in a condition with 70° C.×5 hr and next 130° C.×12 hr.

Meanwhile, for comparison, the extrusion billets of the samples D-R are subjected to a homogenization treatment in a same condition as Nos. 52-54 of the embodiment 1 and then cooled to the room temperature, and next reheated to be extruded into the flat bar shape. The resulted extruded materials are subjected to a solution heat treatment and then hardened in same conditions as Nos. 52-54 of the embodiment 1, and further subjected to an aging treatment in a condition of 70° C.×5 hr and next 130° C.×12 hr to obtain solution heat treated materials (referred as T6 material, below) of the samples D-R.

TABLE 6

| | Chemical composition (% by mass) | | | | | | | | |
|---|---|---|---|---|---|---|---|---|---|
| Sample | Si | Fe | Cu | Mn | Mg | Cr | Zn | Ti | Zr |
| D | 0.04 | 0.18 | 0.07 | 0.15 | 0.55 | 0.15 | 4.50 | 0.05 | 0.08 |
| E | 0.04 | — | 0.15 | — | 1.20 | 0.23 | 4.50 | 0.05 | 0.08 |
| F | 0.04 | 0.18 | 0.40 | 0.45 | 1.20 | — | 4.50 | 0.05 | — |
| G | 0.04 | 0.18 | 0.15 | 0.30 | 0.80 | — | 5.80 | 0.05 | 0.15 |
| H | 0.04 | 0.18 | 0.30 | — | 1.20 | — | 5.80 | 0.05 | 0.15 |
| I | 0.04 | 0.18 | 0.15 | — | 1.80 | 0.25 | 5.80 | 0.05 | — |
| J | 0.04 | 0.18 | 0.25 | 0.40 | 0.55 | 0.15 | 7.50 | 0.05 | — |
| K | 0.04 | 0.18 | 0.45 | 0.65 | 1.80 | 0.45 | 7.50 | 0.05 | 0.22 |
| L | 0.04 | 0.18 | 0.02 | — | 1.20 | — | 5.80 | 0.05 | 0.12 |
| M | 0.04 | 0.18 | 0.15 | — | 0.30 | — | 5.80 | 0.05 | 0.13 |
| N | 0.04 | 0.18 | 0.15 | — | 1.20 | — | 3.50 | 0.05 | 0.14 |
| O | 0.04 | 0.18 | 0.60 | — | 1.20 | — | 5.80 | 0.05 | 0.12 |
| P | 0.04 | 0.18 | 0.20 | — | 2.30 | — | 5.80 | 0.05 | 0.10 |
| Q | 0.04 | 0.18 | 0.15 | — | 1.20 | — | 8.30 | 0.05 | 0.14 |
| R | 0.04 | 0.18 | 0.15 | — | 1.20 | — | 5.80 | 0.05 | — |

TABLE 7

| | | | Manufacturing Condition | | | Tensile Characteristics | | | | | | |
|---|---|---|---|---|---|---|---|---|---|---|---|---|
| | | | Homogenization Treatment | | Die Quenching | | | | | | | |
| | No. | Sample | Heating Rate (° C./hr) | Retention Time (hr) | Cooling Rate (° C./min) | Tensile Strength $TS_0$ ($N/mm^2$) | Proof Stress $YS_0$ ($N/mm^2$) | Elongation (%) | Strength Evaluation $TS/TS_0$ | Strength Evaluation $YS/YS_0$ | Microstructure | SCC Resistance |
| Embodiment | 55 | D | 700 | 0 | 150 | 374 | 317 | 16.2 | 0.98 | 0.98 | Δ | Δ |
| | 56 | E | 500 | 0 | 150 | 425 | 349 | 13.8 | 0.98 | 0.99 | ○ | ○ |
| | 57 | F | 300 | 0 | 150 | 441 | 356 | 14.5 | 0.98 | 0.98 | ○ | ○ |
| | 58 | G | 300 | 3 | 150 | 424 | 363 | 14.2 | 0.97 | 0.98 | ○ | ○ |
| | 59 | H | 1000 | 3 | 150 | 435 | 392 | 15.7 | 0.98 | 0.98 | ○ | ○ |
| | 60 | I | 2000 | 3 | 150 | 513 | 440 | 15.7 | 0.98 | 0.98 | ○ | ○ |
| | 61 | J | 3000 | 4 | 120 | 436 | 386 | 14.5 | 0.98 | 0.97 | ○ | ○ |
| | 62 | K | 3000 | 3 | 120 | 511 | 456 | 13.4 | 0.96 | 0.96 | ○ | ○ |
| Comparison | 63 | L | 700 | 0 | 150 | 422 | 379 | 15.0 | 0.95 | 0.95 | Δ | X |
| | 64 | M | 700 | 0 | 150 | 307 | 226 | 16.0 | 0.99 | 0.98 | Δ | ○ |
| | 65 | N | 700 | 0 | 150 | 319 | 225 | 14.1 | 0.98 | 0.98 | Δ | ○ |
| | 66 | O | 1000 | 3 | 150 | 360 | 326 | 13.5 | 0.81 | 0.81 | ○ | ○ |
| | 67 | P | 2000 | 3 | 150 | 409 | 351 | 14.3 | 0.76 | 0.75 | ○ | X |
| | 68 | Q | 300 | 3 | 150 | 495 | 432 | 14.5 | 0.95 | 0.95 | ○ | X |
| | 69 | R | 300 | 3 | 150 | 416 | 376 | 14.6 | 0.95 | 0.95 | X | X |
| | 70 | D | 3000 | 0 | 120 | 365 | 310 | 15.8 | 0.96 | 0.96 | X | X |
| | 71 | E | 3000 | 2 | 120 | 416 | 338 | 14.3 | 0.96 | 0.96 | X | X |
| | 72 | F | 2000 | 0 | 120 | 430 | 345 | 14.6 | 0.95 | 0.95 | X | X |
| | 73 | G | 2000 | 2 | 120 | 416 | 354 | 14.2 | 0.96 | 0.95 | X | X |

TABLE 7-continued

| | | Manufacturing Condition | | | Tensile Characteristics | | | | | | |
|---|---|---|---|---|---|---|---|---|---|---|---|
| | | Homogenization Treatment | | Die Quenching | Tensile | Proof | | | | | |
| No. | Sample | Heating Rate (° C./hr) | Retention Time (hr) | Cooling Rate (° C./min) | Strength $TS_0$ ($N/mm^2$) | Stress $YS_0$ ($N/mm^2$) | Elongation (%) | Strength Evaluation $TS/TS_0$ | Strength Evaluation $YS/YS_0$ | Micro-structure | SCC Resistance |
| 74 | H | 1000 | 2 | 120 | 426 | 384 | 14.8 | 0.96 | 0.96 | X | X |
| 75 | I | 800 | 0 | 120 | 500 | 428 | 15.2 | 0.95 | 0.95 | X | X |
| 76 | J | 800 | 2 | 120 | 421 | 381 | 15.6 | 0.95 | 0.95 | X | X |
| 77 | K | 700 | 0 | 50 | 448 | 405 | 16.8 | 0.84 | 0.85 | ○ | ○ |

With the extruded material of the sample Nos. 55-77, tensile characteristics, microstructures and CSS resistances are checked in following manners. Notably, T6 materials are examined about only tensile characteristics. The results are shown in table 7.

Tensile Characteristics:

Tensile test peaces under JIS No. 5 are cut out from the extruded materials (Nos. 55-77 and T6 materials) respectively and tensile tests are carried out according to JIS 22241 to measure tensile strengths, proof stresses and elongations. A tensile strength equal to or more than 350 $N/mm^2$ and a proof stress equal to or more than 300$N/mm^2$ are evaluated as good respectively.

Further, calculated are ratios ($Ts/Ts_0$, $Ys/Ys_0$) of the tensile strengths TS and the proof stresses Ys of T5 material (Nos. 55-77) which are subjected to the die quenching and the aging treatment with respect to the tensile strengths $TS_0$ and the proof stresses $Ys_0$ of T6 material, and then materials having a ratio equal to or higher than 0.95 are evaluated as good (○).

Microstructure:

Each extruded material are polished and etched with caustic soda, then observed microscopically to measure average grain diameters of recrystallized grains by intercept method of JIS. Measuring points are on a surface and at a central portion in thickness. Then, materials having average grain diameter of recrystallized grains less than 50 μm at the both measuring points are evaluated as good (○), materials having average grain diameter of recrystallized grains equal to or more than 50 μm and less than 100 μm at the both measuring points are evaluated as mediocre (Δ), materials having average grain diameter of recrystallized grains equal to or more than 100 μm at the both measuring points are evaluated as defect (x).

SCC Resistance:

Evaluation is made with a chromic acid acceleration method. Test peaces are cut out from respective extruded materials, and are applied with tensile stress as 90% of proof stress for Nos. 55-61, 63-76 and tensile stress as 50% of proof stress for Nos. 62, 77 perpendicularly to the extruding direction of each test piece as three-point bending by a jig, with dipping in a test liquid that is 1 little of distilled water added with 36 g of chrome oxide, 30 g of potassium dichromate and 3 g of salt, it is checked whether a crack is present, every 0.5 hours. In this method, test pieces having caused SCC in 6 hours dipping are evaluated as defect (x), test pieces having caused SCC in 6-10 hours of dipping are evaluated as mediocre (Δ), test pieces not having caused SCC in 10 hours of dipping are evaluated as good (○).

Nos. 55-62 all have a composition according to the present invention and are extruded materials manufactured in a manufacturing method according to the present invention. These have tensile strengths and proof stresses more than 95% of the t6 materials and micro-strictures (average diameters of recrystallized grains) less than 100 μm so as to enhance SCC resistances.

However, No. 63 is insufficient in Cu content so that the SCC resistance is poor. No. 64 is insufficient in Mg content and No. 65 is insufficient in Zn content. Therefore, both have poor strength. No. 66 has an excess Cu content which limits the extrusion rate, and therefore a starting temperature of hardening decreases in die quench air cooling. Consequently, the tensile strength and proof stress of No. 65 are less than 95% of the T6 materials. No. 67 has an excess Mg content which limits the extrusion rate, and therefore a starting temperature of hardening decreases in die quench air cooling. Consequently, the tensile strength and the proof stress are less than 95% of the T6 materials. Also, No. 67 has a poor SCC resistance due to the excess Mg content. No. 69 is not added with any one of Mn, Cr and Zr, and therefore the microstructure (average diameter of recrystallized grains) grows to equal to or more than 100 μm. As a result, the SCC resistance is less.

Nos. 70-76 have compositions according to the present invention, but the heating rates in the homogenization treatment are equal to or more than 750° C./hr and the retention time is less that 3 hr. Therefore, recrystallized grains coarsen so as to cause a less SCC resistance. No. 77 has a composition according to the present invention and a heating rate and a retention time in the homogenization treatment which satisfies the prescription of the present invention, but the die quench cooling rate is less than 100° C./min so that the tensile strength and the proof stress are less than 95% of the T6 materials.

What is claimed is:

1. A method for manufacturing an extruded material of a heat treatment type Al—Zn—Mg series aluminum alloy, comprising:

(a) heating a casted ingot of a heat treatment type Al—Zn—Mg series aluminum alloy comprising Zn: 4.0-8.0% by mass, Mg: 0.5-2.0% by mass, Cu: 0.05-0.5% by mass, Ti: 0.01-0.1% by mass, and any one or more of Mn: 0.1-0.7% by mass, Cr: 0.1-0.5% by mass and Zr: 0.05-0.3% by mass, and the balance being aluminum and incidental impurities, to a homogenization treatment temperature at a heating rate of equal to or more than 70° C./hr and equal to or less than 750° C./hr;

(b) extruding the heated casting ingot from (a) at the homogenization treatment temperature;

(c) die quenching the extruded material from (b) at a cooling rate equal to or more than 100° C./min; and (d) subjecting the die quenched material from (c) to an artificial aging treatment.

2. The method of claim 1, wherein the homogenization treatment temperature is 430-500° C.

3. The method of claim 1, wherein the extruded material from (b) is cooled to 50° C. or less in (c).

* * * * *